US006357062B1

(12) United States Patent
Woll et al.

(10) Patent No.: US 6,357,062 B1
(45) Date of Patent: Mar. 19, 2002

(54) FRAME CONVERTIBLE INTO COUCH OR BED

(75) Inventors: William J. Woll, Quail Valley; Steven F. Leichter, Walnut, both of CA (US)

(73) Assignee: Harlee International, Walnut, CA (US)

( * ) Notice: Subject to any disclaimer, the term of this patent is extended or adjusted under 35 U.S.C. 154(b) by 0 days.

(21) Appl. No.: 09/561,511

(22) Filed: Apr. 27, 2000

(51) Int. Cl.[7] ..... A47C 17/17; A47C 17/04
(52) U.S. Cl. ..... 5/37.1; 5/47
(58) Field of Search ..... 5/37.1, 47, 41

(56) References Cited

U.S. PATENT DOCUMENTS

| | | | | |
|---|---|---|---|---|
| 5,664,268 A | | 9/1997 | Stoller et al. | 5/37.1 |
| 5,940,907 A | * | 8/1999 | Stoler et al. | 5/37.1 |
| 5,956,785 A | * | 9/1999 | Fireman | 5/37.1 |
| 6,108,833 A | * | 8/2000 | Grossman et al. | 5/37.1 |

* cited by examiner

*Primary Examiner*—Alexander Grosz
(74) *Attorney, Agent, or Firm*—Klein & Szekeres LLP

(57) ABSTRACT

A futon frame that has a seat piece and back piece pivotably joined to one another so that they can occupy substantially flat and also angled configurations relative one another. In the flat configuration the pieces serve as a couch or futon, and in the angled configuration they serve as a couch or sofa. The joined seat and back pieces move in rollers in appropriately positioned slots in side arms and legs which are joined at each distal end to the seat and back pieces. Each of the flat (sleeping or bed) or angled (seating or couch) position or configuration of the pieces is held stable for use by the rollers that become lodged in the ends of the respective guide slots. A solid block is attached below the back piece that engages the seat piece when the frame is converted from bed to couch. The block allows the seat piece to be used as an efficient lever to raise the back piece without major physical effort while the edge of the seat piece is pushed and used as a lever handle. The block includes a rounded or curved corner that act as a camming surface and facilitates passing of the seat in contact with block during conversion of the futon frame from bed to couch or couch to bed position.

15 Claims, 5 Drawing Sheets

FRAME CONVERTIBLE INTO COUCH OR BED

BACKGROUND OF THE INVENTION

1. Field of the Invention

The present invention is in the field of furniture design. More particularly, the present invention relates to a frame which is readily convertible from a substantially flat bed or futon like configuration into a couch, and is equally readily convertible in reverse.

2. Brief Description of the Prior Art

Convertible couches and sofas have been known in the prior art for a long time. Applicant believes that the closest known prior art to the invention is the special construction of a futon frame convertible into a couch frame, described in U.S. Pat. No. 5,664,268. Whereas the futon frame of this prior art patent is workable and suitable for its intended purpose, it still requires substantial physical effort by a person to convert it from one function to the other, that is from bed or futon to seat and vica versa, and particularly to convert it from the futon or bed position into the sitting or couch position. The present invention solves this problem and provides a bed or futon frame that can be converted into a sitting or couch configuration with greater ease and less physical effort than comparable convertible couch or sofa beds of the prior art.

SUMMARY OF THE INVENTION

It is an object of the present invention to provide a futon or bed frame that is readily convertible into a couch or sitting configuration, and vica versa, without major physical effort.

It is another object of the present invention to provide a futon or bed frame that is readily convertible into a couch or sitting configuration, and vica versa, which is aesthetically pleasing to view and comfortable to use.

The foregoing and other objects and advantages attained by a frame that has a seat piece and back piece pivotably joined to one another so that they can occupy substantially flat and also angled configurations relative one another. In the flat configuration the pieces serve as a couch or futon, and in the angled configuration they serve as a couch or sofa. The joined seat and back pieces move in rollers in appropriately positioned slots in side arms and legs which are joined at each distal end to the seat and back pieces. Each of the flat (sleeping or bed) or angled (seating or couch) position or configuration of the pieces is held stable for use by the rollers that become lodged in the ends of the respective guide slots. A solid block is attached below the back piece that engages the seat piece when the frame is converted from bed to couch. The block allows the seat piece to be used as an efficient lever to raise the back piece without major physical effort while the edge of the seat piece is pushed and used as a lever handle.

The features of the present invention can be best understood together with further objects and advantages by reference to the following description, taken in connection with the accompanying drawings, wherein like numerals indicate like parts.

DESCRIPTION OF THE PREFERRED EMBODIMENTS

Figure 1:
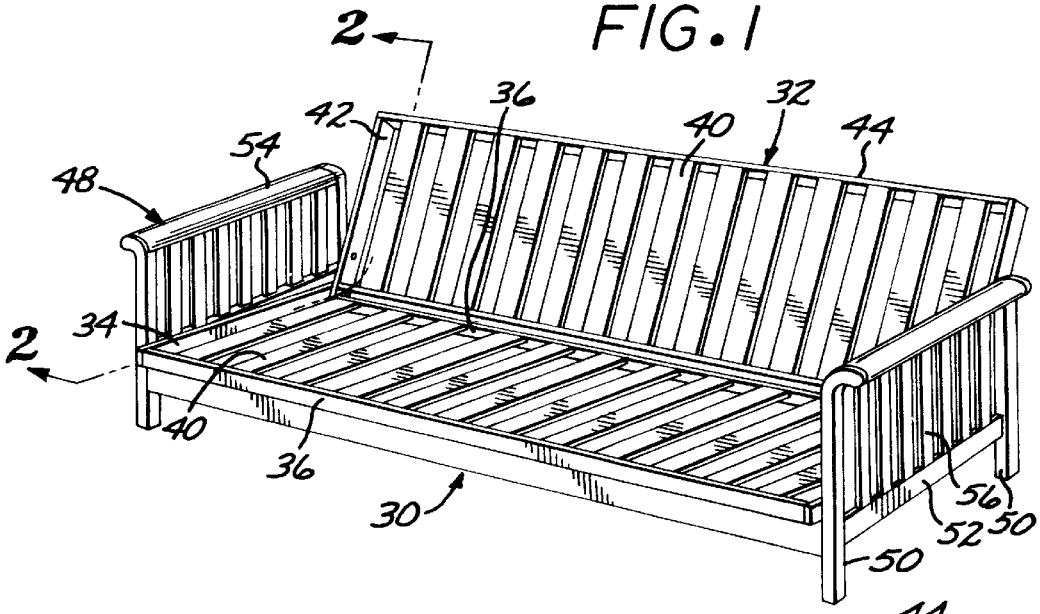
FIG. 1 is a perspective view of the improved convertible bed and couch frame of the invention, showing the frame configured as a couch.

The following specification taken in conjunction with the drawings sets forth the preferred embodiment of the present invention. The embodiment of the invention disclosed herein is the best mode contemplated by the inventors for carrying out their invention in a commercial environment, although it should be understood that various modifications can be accomplished within the parameters of the present invention.

Referring now to the drawing figures, a preferred embodiment of the novel and improved frame that is convertible from bed or futon into a couch or sofa, and vica versa, is shown. The frame of the present invention is believed to represent a significant improvement over all known prior art, primarily in terms of lack of major physical effort needed for converting it from bed or futon configuration into couch or sofa configuration. However, in many aspects of its construction it bears similarity to the prior art convertible futon—couch frame of U.S. Pat. No. 5,664,268. For a detailed description of several aspects of the frame of the present invention which are similar in the device of U.S. Pat. No. 5,664,268 and in the present invention, the specification of U.S. Pat. No. 5,664,268 is expressly incorporated herein by reference.

The frame of the invention, as shown in the preferred embodiment includes a substantially rectangular piece 30 that is shown in FIG. 1 as the seat (seat piece 30). Another substantially rectangular piece is shown in FIG. 1 as the back support piece 32. The seat piece 30 itself comprises a frame made from pairs of parallel disposed shorter 34 and longer 36 pieces with slats 40 attached by dove tailing the slats 40 into the longer pieces 36. The shorter 34 and longer 36 pieces are also attached to one another by dove tailing as indicated with the numeral 38 in FIG. 2. The back piece 32 is of similar construction, made from shorter 42 and longer 44 pieces or boards, equipped with slats 40 dove tailed into the longer boards 44. The dove tailed part is shown in broken-away cross-section in FIG. 5 with the numeral 46. The seat 30 and back 32 pieces with the slats 40 support padding or cushions which are not shown in the drawings figures, because the padding or cushions, per se, do not comprise part of the invention. All of the herein described components, except for the padding or cushions (not shown), screws and rollers (described below), are preferably made from wood, although they could also be made from other materials, such as metals, or plastic suitable for furniture construction. A combination of wood, metal and plastic could also be used. Two substantially identical side pieces 48 serve as leg support for the frame, and also serve as arm-rests when the frame is used as a couch. Each side piece 48 includes two legs 50, a horizontal cross-piece 52, an arm-rest piece 54, and vertical members or slats 56. Those skilled in the art will readily understand that the foregoing is a description of the preferred embodiment, and that several modifications in style and construction of the side pieces 48 can be made without departing from the spirit and scope of the invention.

Figure 2:
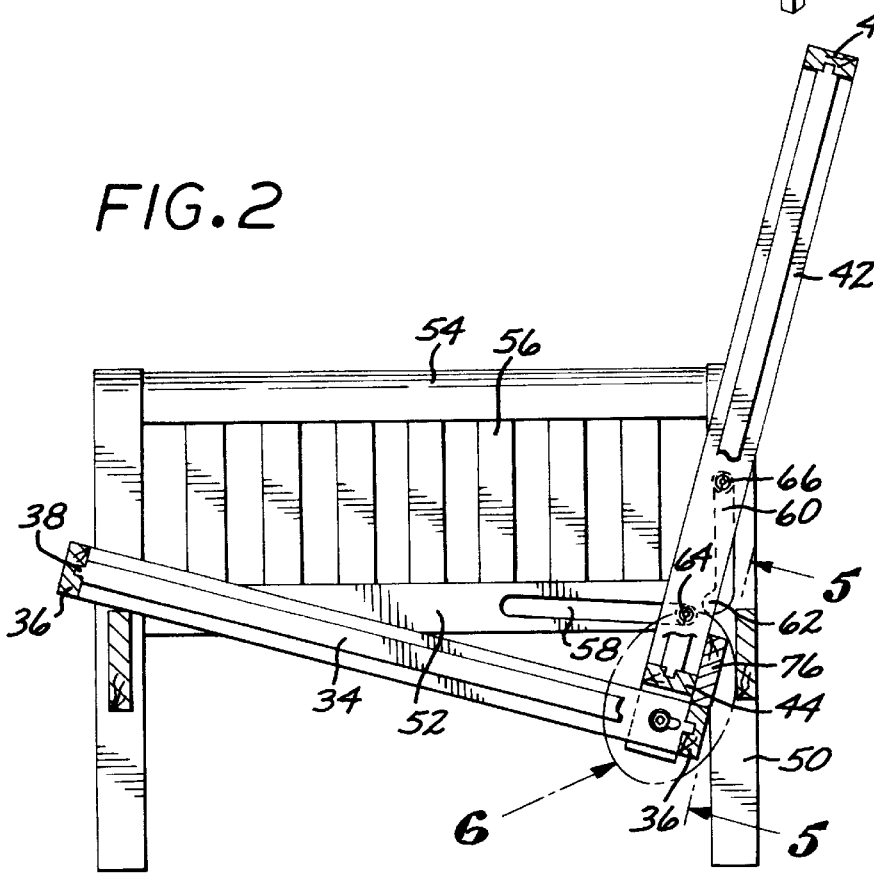
FIG. 2 is a cross-sectional view taken on lines 2,2 of FIG. 1, showing the frame configured as a couch.
Figure 4:
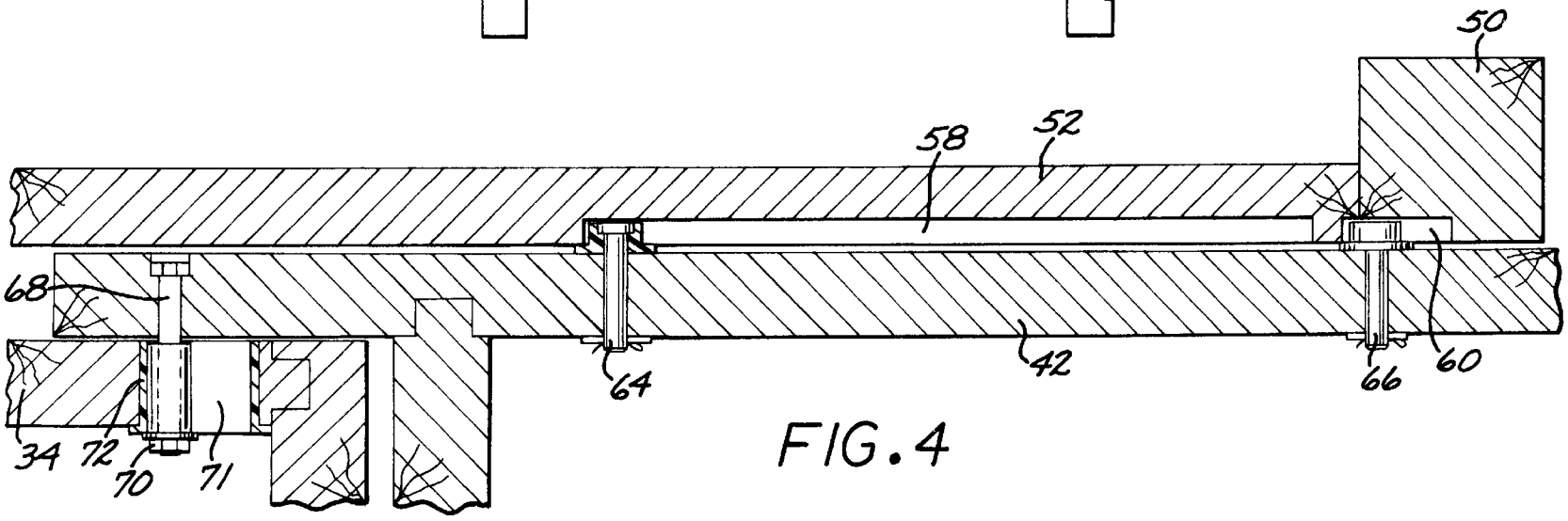
FIG. 4 is cross-sectional view taken on lines 4,4 of FIG. 3, showing the frame configured as a bed or futon.

A slot 58 that is inclined in a small angle from the horizontal is disposed in the horizontal cross-piece 52 of each side piece 48. A substantially vertical slot 60 having an extension 62 at an angle from the main thrust of the slot 60 is disposed in each rear leg 50. Rollers 64 and 66 which are attached to the shorter boards 42 of the back piece 32 are disposed in the slots 58 and 60, respectively. The rollers 64 and 66 are best seen in FIG. 4, whereas the slots 58 and 60 are best seen in FIG. 2. The side or shorter board 34 of the seat piece 30 is attached to the shorter board 42 of the back piece 32 with a bolt 68 and nut 70. The bolt 68 is enclosed in a plastic sleeve 72 which allows the bolt 68 to roll in a substantially horizontally disposed slot 74 that is formed in the shorter board 34 of the seat 30. The bolt 68 attaching the seat piece 30 to the back piece 32 and the slot 74 are best seen in FIG. 4.

Figure 3:
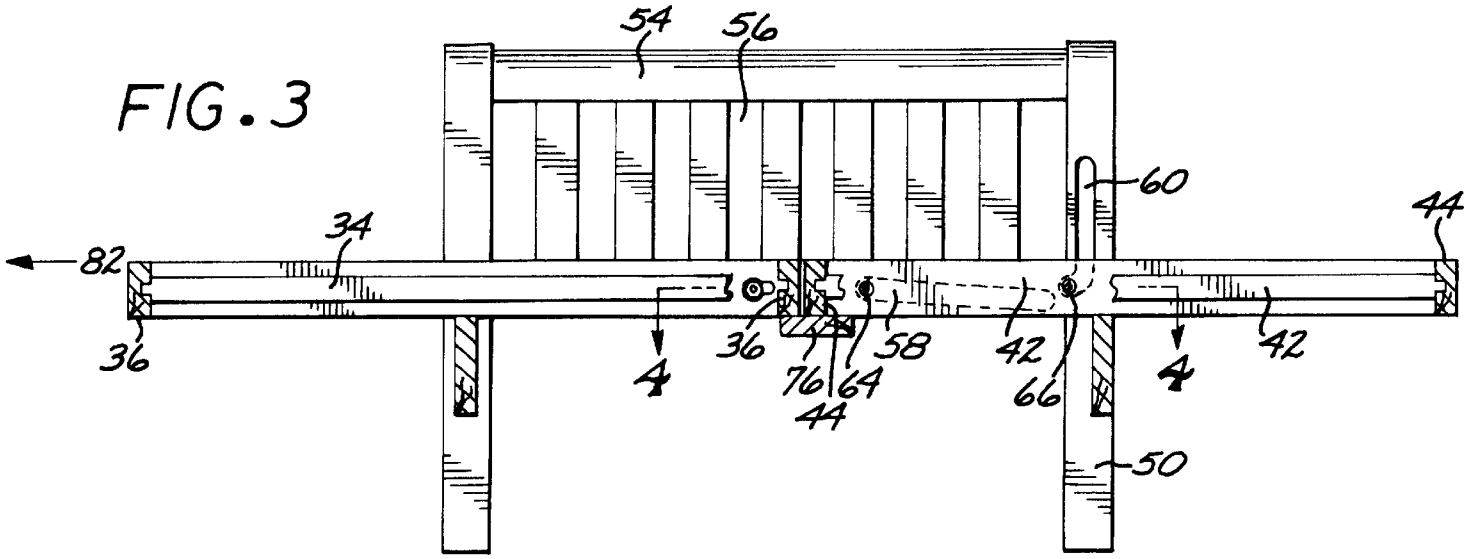
FIG. 3 is cross-sectional view, analogous to the cross-section taken on lines 2,2 of FIG. 1 but showing the frame configured as a bed or futon.
Figure 5:
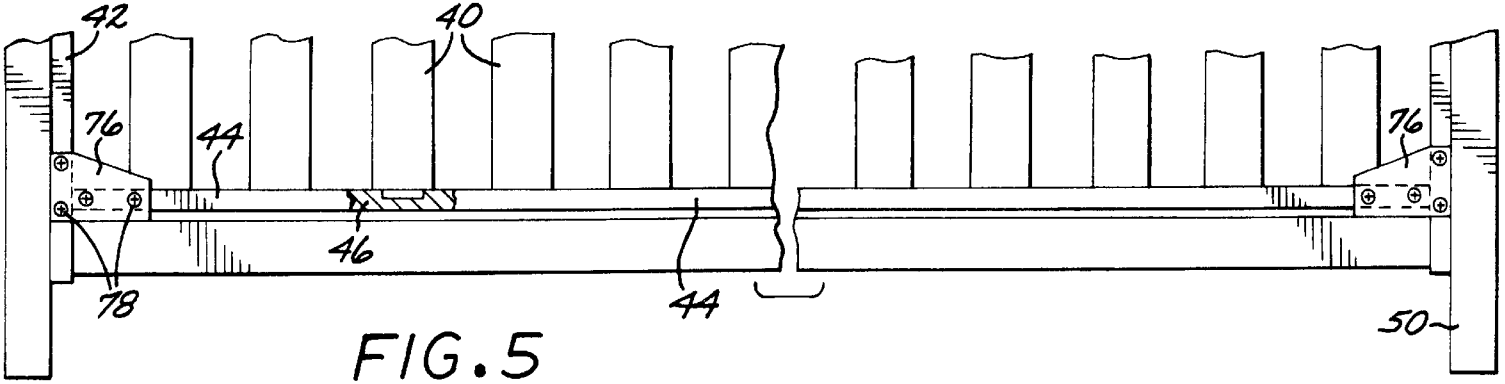
FIG. 5 is a rear view, taken on lines 5,5 of FIG. 2, showing the frame configured as a couch.
Figure 6:
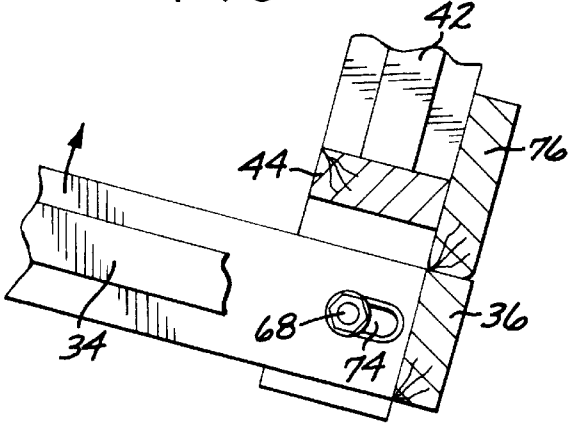
FIG. 6 is an enlarged view taken in the area shown in FIG. 2, showing the frame configured as a couch.
Figure 7:
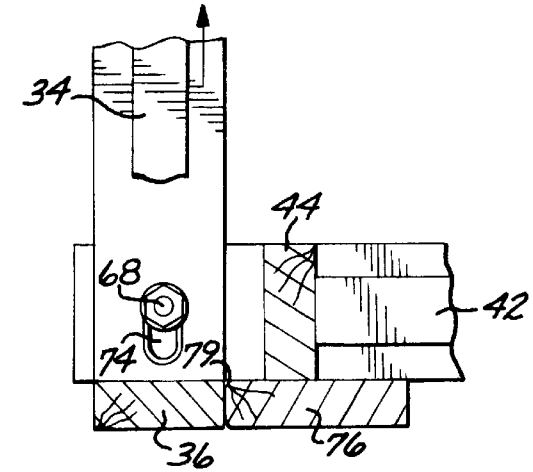
FIGS. 7, 8, and 9 are enlarged views taken in the area shown in FIG. 2, and showing the frame being converted from couch configuration into bed configuration.

FIGS. 2, 3 and 5–13 show a solid block 76 attached at each end of the longer board 44 of the back piece 32. The blocks 76 extend a short distance, in this embodiment approximately 16 to 25 mm, preferably 20 mm, below the bottom edge of the longer board 44, and are also attached to the shorter board 42 of the back piece 32. Screws 78 attaching the blocks 76 to the back piece 32 are shown in FIG. 5. The blocks 76 play an important role in the operation of the convertible frame and comprise a principal novel aspect of the present invention, because their presence and placement renders the conversion of the frame from bed configuration to sofa or couch configuration physically much less demanding than in the comparable convertible frame of the prior art. The blocks 76 can be made from wood, metal or plastic, however they need to be structurally strong because as described below, they transmit substantial load or force during conversion of the frame from bed to couch configuration. In the preferred embodiment the blocks 76 comprise wood. In this regard it will be readily understood by those skilled in the art that the blocks 76 should preferably extend that distance below the bottom edge of the longer board 44 which allows it to be in substantially precise abutment with the seat 30 as shown in FIGS. 3 and 6. A comer of the block 76 is rounded or curved to provide a camming surface 79 for the longer board 36 of the seat 30 when the frame or futon of the invention is converted from one position to another and the longer board 36 passes by or slides on the block 76, as is described below.

Figure 13:
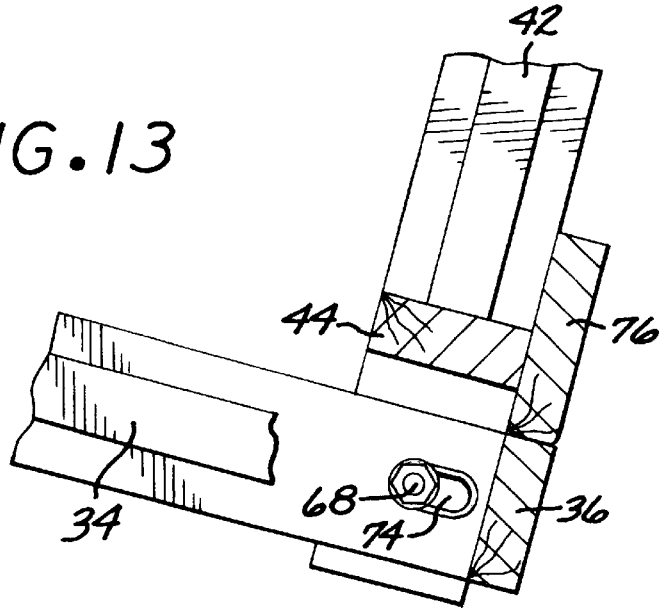

FIG. 2 illustrates the frame of the invention in the configuration of a couch. In this configuration the block 76 abuts and sits atop the longer piece 36 of the seat 30. This is also shown in FIGS. 6 and 13. FIG. 3 shows the frame in the configuration of a bed or futon, where the block 76 is disposed below the longer piece 36 of the seat 30. In this position or configuration the block 76 also acts to help support weight of the seat piece 30 and any load, such as a person lying on the seat piece 30. FIGS. 6 through 9 illustrate how the frame is converted from couch into bed or futon configuration, with particular emphasis on the role of the block 76. In this process the rollers 64 and 66 and bolt 68 in the plastic sleeve 72 function substantially similarly as in the device described in U.S. Pat. No. 5,664,268.

Figure 8:
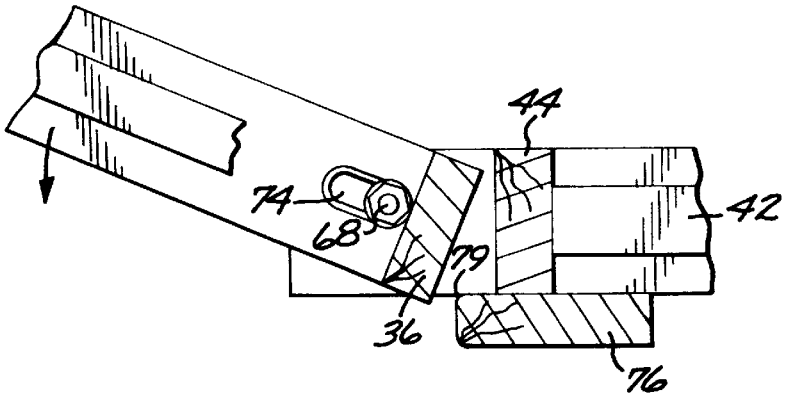
Figure 9:
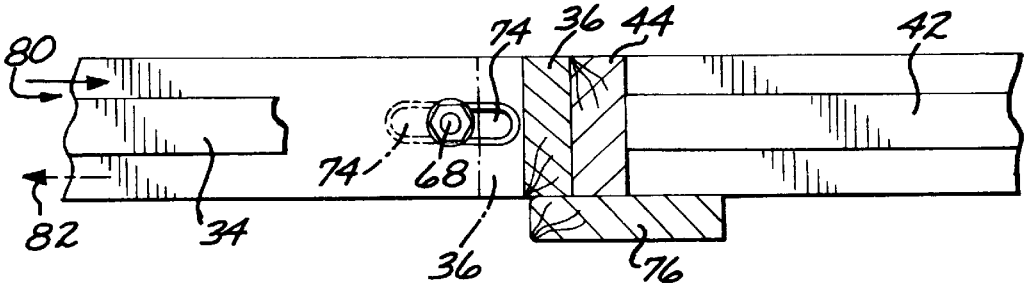
Figure 10:
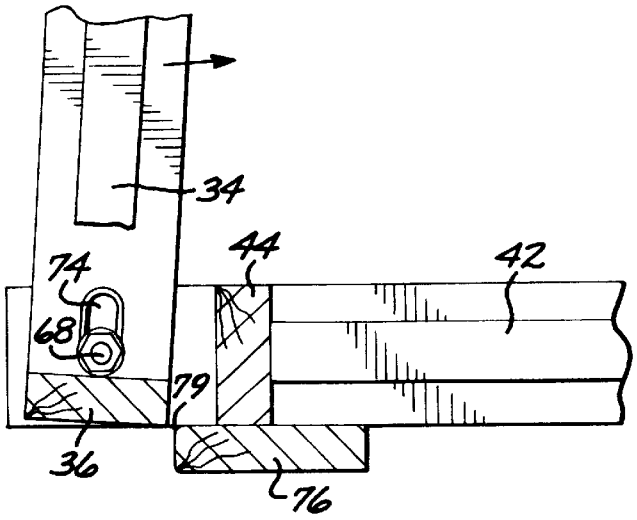
FIGS. 10, 11, 12 and 13 are enlarged views taken in the area shown in FIG. 2, and showing the frame being converted from bed configuration into couch configuration.

Thus, in order to make a bed out of the couch, a person (not shown) lifts the seat 30 in the direction of the arrow in FIG. 6. This causes the back piece 32 to pivot into the substantially horizontal position shown in FIG. 7. During this process the roller 64 moves slightly forward in the slightly inclined slot 58 and the roller 66 moves downward in the vertical slot 60 and comes to rest in its angled extension 62. The person or operator (not shown) then pulls the seat 30 slightly upward as shown by the arrow in FIG. 7, as far as the plastic sleeve 72 enclosing the bolt 68 in the slot 74 allows. In this process the long board 36 of the seat 30 is removed from abutment with the block 76 and the seat 30 becomes free to rotate relative to the back piece 32. FIG. 8 shows the seat 30 being rotated in the direction of the arrow in the figure, to eventually come to rest in a substantially horizontal position. While this movement occurs, the rounded corner of the block 76 acting as a camming surface 79 facilitates rotation and movement of the seat 30 because it allows smooth passing of the long board 36 of the seat 30 by the block 76. Once the seat 30 is in a horizontal position it is preferably pushed slightly towards the back piece 32 (arrow 80 pointing to the right in FIG. 9) as far as the plastic sleeve 72 in the slot 74 and or the back piece 32 allow. In this position, suitable for use as a bed, the long board 36 rests on the block 76, as shown in FIG. 9. In this position the block 76 helps to make sure that the bed or futon does not collapse in a V form when weight, such as a human body, is placed on the bed.

Figure 11:
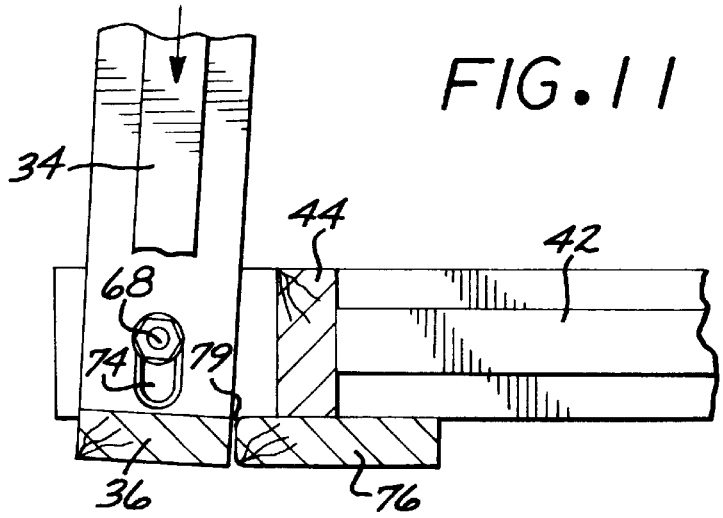
Figure 12:
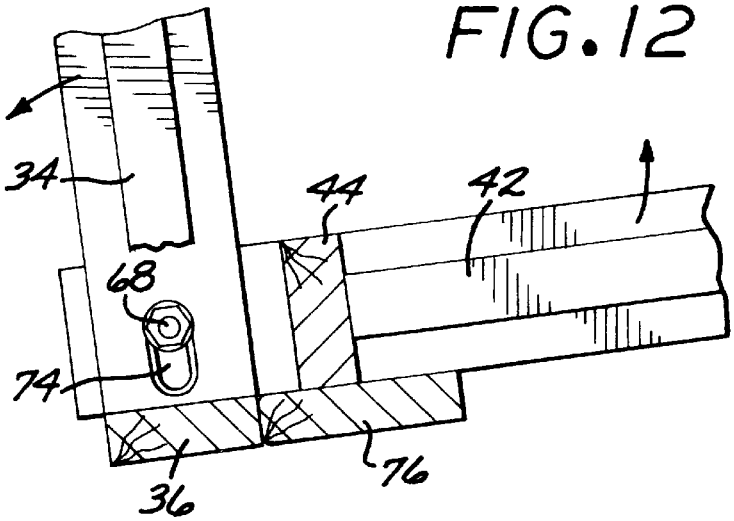

FIG. 9 also shows (arrow 82 pointing to the left) the beginning of the process when the bed or futon is converted into the seat or couch configuration. This process is further illustrated by FIGS. 10 through 13. The seat 30 is moved forward in the direction shown by the arrow 82 in FIGS. 3 and 9 so as to again move the plastic sleeve 72 enclosing the bolt 68 to the end of the slot 74, and the seat 30, still preferably held at its front, is then rotated upward to reach the position shown in in FIG. 10. Thereafter, the seat 30 is pushed or allowed to drop down as far as the bolt 68 and the plastic sleeve 72 permit it to go within the slot 74. This is shown in FIGS. 11 and 12. The seat 30, still preferably held at its front edge, is then used as a powerful lever while it is pushed and rotated downward. In this configuration the longer board 36 of the seat 30 abuts and pushes against the block 76, causing the back piece 32 to lift into the position where the frame is configured as a couch or sofa. It is in this last steps of the process of the conversion where the block 76 is particularly helpful and renders the conversion from bed to couch significantly less demanding of physical effort than similar conversion in the prior art.

What has been described above is a convertible couch or sofa bed having a construction that allows substantially effortless conversion of the sofa bed from bed to couch and couch to bed configuration. Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. A futon convertible from a couch position to a bed position and vica versa, comprising:

a substantially rectangular seat forming a frame having a shorter and a longer side, the seat including substantially parallel disposed side boards at the two shorter sides of the frame, each side board including a slot, the seat serving as a first pad support member;

a pair of side pieces including front and rear leg pieces and a substantially horizontally disposed cross-piece, one side piece being disposed adjacent to each side board of the seat piece, each side board including an elongated slot in the cross piece and an elongated slot in the rear leg piece;

a substantially rectangular back forming a frame having a shorter and longer side, the back including substantially parallel disposed side boards at the two shorter sides of the frame, each side board including a first member fixedly attached to the side board of the back, engaging the slot in the cross piece of the side piece and capable of moving therein; and a second member fixedly attached to the side board of the back engaging the slot in the rear leg piece, and a third member fixedly attached to the side board of the back engaging the slot in the side board of the seat and capable of moving therein whereby the seat can have two extreme positions relative to the slot in the side board of the seat, in a first of said extreme positions the seat being not pivotable relative to the back, and a second of said extreme positions the seat being pivotable relative to the back, and a block fixedly attached to the back, the block resting on the seat when the seat is in the first of said extreme positions, and the block being removed from contact with the seat in the second of said extreme positions, the block acting as means for transmitting force from the seat to the back when the seat in its first extreme position is rotated to lift the back while converting the futon from bed into couch position.

2. The futon convertible from a couch position to a bed position and vica versa in accordance with claim 1 wherein the block includes a curved surface to act as a camming surface when the the seat comes into moving contact with the block during conversion from bed position to couch position and vica versa.

3. The futon convertible from a couch position to a bed position and vica versa in accordance with claim 1 wherein the block extends approximately 16 to 25 mm below the back.

4. The futon convertible from a couch position to a bed position and vica versa in accordance with claim 1 wherein the first member comprises a roller to roll within the slot in the cross piece of the side piece.

5. The futon convertible from a couch position to a bed position and vica versa in accordance with claim 1 wherein the second member comprises a roller to roll within the slot in the rear piece.

6. The futon convertible from a couch position to a bed position and vica versa in accordance with claim 1 wherein the third member comprises a bolt enclosed in a sleeve to move within the slot in the side board of the seat.

7. The futon convertible from a couch position to a bed position and vica versa in accordance with claim 1 further comprising slats mounted within the seat to support pads.

8. The futon convertible from a couch position to a bed position and vica versa in accordance with claim 1 further comprising slats mounted within the back to support pads.

9. In a futon convertible from a couch position to a bed position and vica versa, that comprises:

a substantially rectangular seat forming a frame having a shorter and a longer side, the seat including substantially parallel disposed side boards at the two shorter sides of the frame, each side board including a slot, the seat serving as a first pad support member;

a pair of side pieces including front and rear leg pieces and a substantially horizontally disposed cross-piece, one side piece being disposed adjacent to each side board of the seat piece, each side board including an elongated slot in the cross piece and an elongated slot in the rear leg piece;

a substantially rectangular back forming a frame having a shorter and longer side, the back including substantially parallel disposed side boards at the two shorter sides of the frame, each side board including a first member fixedly attached to the side board of the back, engaging the slot in the cross piece of the side piece and capable of moving therein; and a second member fixedly attached to the side board of the back engaging the slot in the rear leg piece, and a third member fixedly attached to the side board of the back engaging the slot in the side board of the seat and capable of moving therein whereby the seat can have two extreme positions relative to the slot in the side board of the seat, in a first of said extreme positions the seat being not pivotable relative to the back, and a second of said extreme positions the seat being pivotable relative to the back, the improvement comprising:

a block fixedly attached to the back, the block resting on the seat when the seat is in the first of said extreme positions, and the block being removed from contact with the seat in the second of said extreme positions, the block acting as means for transmitting force from the seat to the back when the seat in its first extreme position is rotated to lift the back while converting the futon from bed into couch position.

10. The improvement of claim 9 further comprising a curved surface formed in the block to act as a camming surface when the the seat comes into moving contact with the block during conversion from bed position to couch position and vica versa.

11. The improvement of claim 9 wherein the block extends approximately 16 to 25 mm below the back.

12. The improvement of claim 9 wherein the block is fixedly attached to members forming the longer and the shorter sides of the back.

13. The improvement of claim 9 wherein the block comprises wood.

14. The improvement of claim 9 wherein the block is attached to the back with screws.

15. The improvement of claim 9 wherein the block extends approximately 16 to 25 mm below the back, the block is fixedly attached to members forming the longer and the shorter sides of the back, the block comprises wood, the block is attached to the back with screws and the block comprises a curved surface to act as a camming surface when the the seat comes into moving contact with the block during conversion from bed position to couch position and vica versa.

* * * * *